US007780355B2

(12) United States Patent
Malloy

(10) Patent No.: US 7,780,355 B2
(45) Date of Patent: Aug. 24, 2010

(54) CARRY BAG

(75) Inventor: John Leo Malloy, Dunsborough (AU)

(73) Assignee: Great Waves Pty. Ltd., Dunsborough, Western Australia (AU)

( * ) Notice: Subject to any disclaimer, the term of this patent is extended or adjusted under 35 U.S.C. 154(b) by 583 days.

(21) Appl. No.: 11/548,254

(22) Filed: Oct. 10, 2006

(65) Prior Publication Data

US 2007/0183693 A1 Aug. 9, 2007

(30) Foreign Application Priority Data

Oct. 11, 2005 (AU) ..... 2005905594

(51) Int. Cl.
*B65D 30/08* (2006.01)
*B65D 30/20* (2006.01)
*B65D 85/20* (2006.01)

(52) U.S. Cl. ..... 383/109; 383/120; 383/907; 206/315.1

(58) Field of Classification Search ..... 383/2, 383/109, 119, 120, 907, 121, 122, 110; 150/154, 150/127; 190/103, 104, 105, 107; 220/660; 206/315.1
See application file for complete search history.

(56) References Cited

U.S. PATENT DOCUMENTS

| | | | | |
|---|---|---|---|---|
| 2,051,993 | A * | 8/1936 | Geib | 206/14 |
| 2,886,085 | A * | 5/1959 | Sanger | 383/120 |
| 3,074,617 | A * | 1/1963 | Kindseth et al. | 383/119 |
| 5,094,344 | A * | 3/1992 | Savage | 206/315.1 |
| 5,147,235 | A * | 9/1992 | Bamburak et al. | 441/79 |
| 5,472,279 | A * | 12/1995 | Lin | 383/2 |
| 5,892,202 | A * | 4/1999 | Baldwin et al. | 219/387 |
| 6,003,745 | A * | 12/1999 | Mechanic | 206/315.1 |
| 6,053,382 | A * | 4/2000 | Wyant | 190/103 |
| 6,334,537 | B1 * | 1/2002 | Tepper | 206/315.1 |
| 6,367,674 | B1 * | 4/2002 | Tabor | 224/650 |
| 2003/0042277 | A1 * | 3/2003 | Gulmatico, III | 224/153 |

* cited by examiner

*Primary Examiner*—Jes F Pascua
(74) *Attorney, Agent, or Firm*—Gerald E. Helget; Nelson R. Capes; Briggs and Morgan, P.A.

(57) ABSTRACT

A carry bag (10) intended to accommodate a surfboard, the bag (10) comprising a pair of major panels (11, 13) which have the general configuration of the surfboard to be accommodated by the bag (10), the major panels (11, 13) being interconnected around their perimeter by a side wall (15) formed of a flexible sheet material, a fold line (21) being formed for substantially the full extent of the side wall (15) substantially intermediate to the major panels (11, 13).

5 Claims, 4 Drawing Sheets

CARRY BAG

FIELD OF THE INVENTION

This invention relates to carry bags in particular carry bags which are intended to accommodate items such as surfboards, body boards and the like.

BACKGROUND ART

A particular application of the invention relates to carry bags which can be utilised in carrying surfboards, body boards and the like. Such carry bags have become common place in the transportation of surfboards for the purposes of protecting the surfboards in transportation and for ease of transportation. In the case of surfboards the difficulty that is created is that the carry bags tend to be quite voluminous in order to be able to accommodate the surfboard and as a result can be difficult to carry and occupy a large amount of space both when empty and when containing a surfboard. This situation is further exacerbated by the fact that they are often formed of a multi-layered material which includes a layer of a padding material which can become bunched around the sides of the bag.

DISCLOSURE OF THE INVENTION

The present invention provides a carry bag intended to accommodate an item, the bag comprising a pair of major panels which have the general configuration of the item to be accommodated by the bag, the major panels being interconnected around their perimeter by a side wall formed of a flexible sheet material, a fold line being formed for substantially the full extent of the side wall substantially intermediate to the major panels.

Preferably, the flexible sheet material comprises a multi-layered material. The flexible sheet material preferably comprises outer layers of a suitable fabric or sheet-like material and an inner padding layer The fold line is preferably defined by an interconnection between the layers. The interconnection preferably comprises stitching interconnecting the layers along the fold line. The stitching preferably extends between the outer most layers of the side wall and holds these layers in close contact with the padding layer. Alternatively, the interconnection comprises welding of the layers along the fold line.

The side wall preferably includes an end panel formed of the flexible sheet material, the end panel having a plurality of second fold lines in substantially parallel spaced relationship across the width of the end panel. Preferably, the end panel includes an intermediate fold line aligned with the fold line of the side wall. The second fold lines preferably include fold lines disposed to each side of the intermediate fold line and substantially parallel thereto. The second fold lines are preferably formed by stitching interconnecting the outer layers of the material forming the end panel. Preferably, the end panel includes a central fold line substantially perpendicular to the intermediate fold line. The central fold line is preferably formed by stitching interconnecting the outer layers of the material forming the end panel.

In the region of the side wall adjacent each end of the end panel, the side wall is preferably formed with a pair of divergent fold lines which extend from the intermediate fold line towards the end panel in a divergent manner.

The end panel preferably forms an integral part of the side wall. Alternatively, the end panel is defined as a separate panel incorporated into the side wall.

The major panels are preferably formed of the flexible sheet material. Alternatively, the major panels are substantially rigid.

One of the major panels preferably includes a closure substantially extending around the perimeter of the major panel to provide access into the interior of the carry bag.

The major panels preferably have the general configuration of a surfboard which is to be carried by the bag in that the panels are shaped to substantially correspond to the shape of the surfboard. The side wall is preferably of varying widths such that when the carry bag accommodates a surfboard having a tail fin at the rear end, the bag can accommodate the tail fin. Preferably, the side wall is generally tapered from the rear end to the front end of the carry bag.

Preferably, the edges of the side wall adjacent the major panels are provided with a set of fasteners which enable the edges of the major panels to be held in close abutting relationship when the side wall is folded inwardly of the edges.

In another aspect, the present invention provides a carry bag intended to accommodate a surfboard, the bag comprising a pair of major panels which have the general configuration of the surfboard to be accommodated by the bag, the major panels being interconnected around their perimeter by a side wall formed of a flexible sheet material, a fold line being formed for substantially the full extent of the side wall substantially intermediate to the major panels for folding the side wall inwardly, wherein the flexible sheet material comprises outer layers of a suitable fabric or sheet-like material and an inner padding layer and wherein the fold line is defined by stitching extending between the outer layers of the side wall and holding these layers in close contact with the padding layer.

The side wall preferably includes an end panel formed of the flexible sheet material, the end panel having an intermediate fold line aligned with the fold line of the side wall and second fold lines disposed to each side of the intermediate fold line and substantially parallel thereto. The end panel preferably includes a central fold line substantially perpendicular to the intermediate fold line.

In the region of the side wall adjacent each end of the end panel, the side wall is preferably formed with a pair of divergent fold lines which extend from the intermediate fold line towards the end panel in a divergent manner. The end panel preferably forms an integral part of the side wall. The major panels are preferably formed with the flexible sheet material. Alternatively, the major panels are substantially rigid.

The side wall is preferably generally tapered from the rear end to the front end of the carry bag such that when the carry bag accommodates a surfboard having a tail fin at the rear end, the bag can accommodate the tail fin.

The edges of the side wall adjacent the major panels are preferably provided with a set of fasteners which enable the edges of the major panels to be held in close abutting relationship when the side wall is folded inwardly of the edges.

In another aspect, the present invention provides a carry bag intended to accommodate a surfboard, the bag comprising a pair of major panels which have the general configuration of the surfboard to be accommodated by the bag, the major panels being interconnected around their perimeter by a side wall formed of a flexible sheet material, a fold line being formed for substantially the full extent of the side wall substantially intermediate to the major panels for folding the side wall inwardly, wherein the side wall includes an end panel formed of the flexible sheet material, the end panel having an intermediate fold line aligned with the fold line of the side wall and second fold lines disposed to each side of the intermediate fold line and substantially parallel thereto for folding the end panel inwardly.

In another aspect, the present invention provides a carry bag intended to accommodate a surfboard, the bag comprising a pair of major panels which have the general configuration of the surfboard to be accommodated by the bag, the major panels being interconnected around their perimeter by a side wall formed of a flexible sheet material, a fold line being formed for substantially the full extent of the side wall substantially intermediate to the major panels for folding the side wall inwardly, wherein the side wall is generally tapered from the rear end to the front end of the carry bag such that when the carry bag accommodates the surfboard having a tail fin at the rear end, the bag can accommodate the tail fin, wherein the side wall includes an end panel formed of the flexible sheet material, the end panel having an intermediate fold line aligned with the fold line of the side wall and second fold lines disposed to each side of the intermediate fold line and substantially parallel thereto for folding the end panel inwardly, the end panel further including a central fold line substantially perpendicular to the intermediate fold line and wherein in the region of the side wall adjacent each end of the end panel, the side wall is formed with a pair of divergent fold lines which extend from the intermediate fold line towards the end panel in a divergent manner.

The invention will be more fully understood in the light of the following description of a specific embodiment.

BRIEF DESCRIPTION OF THE DRAWINGS

The description is made with reference to the accompanying drawings of which.

DETAILED DESCRIPTION OF SPECIFIC EMBODIMENT

Figure 1:
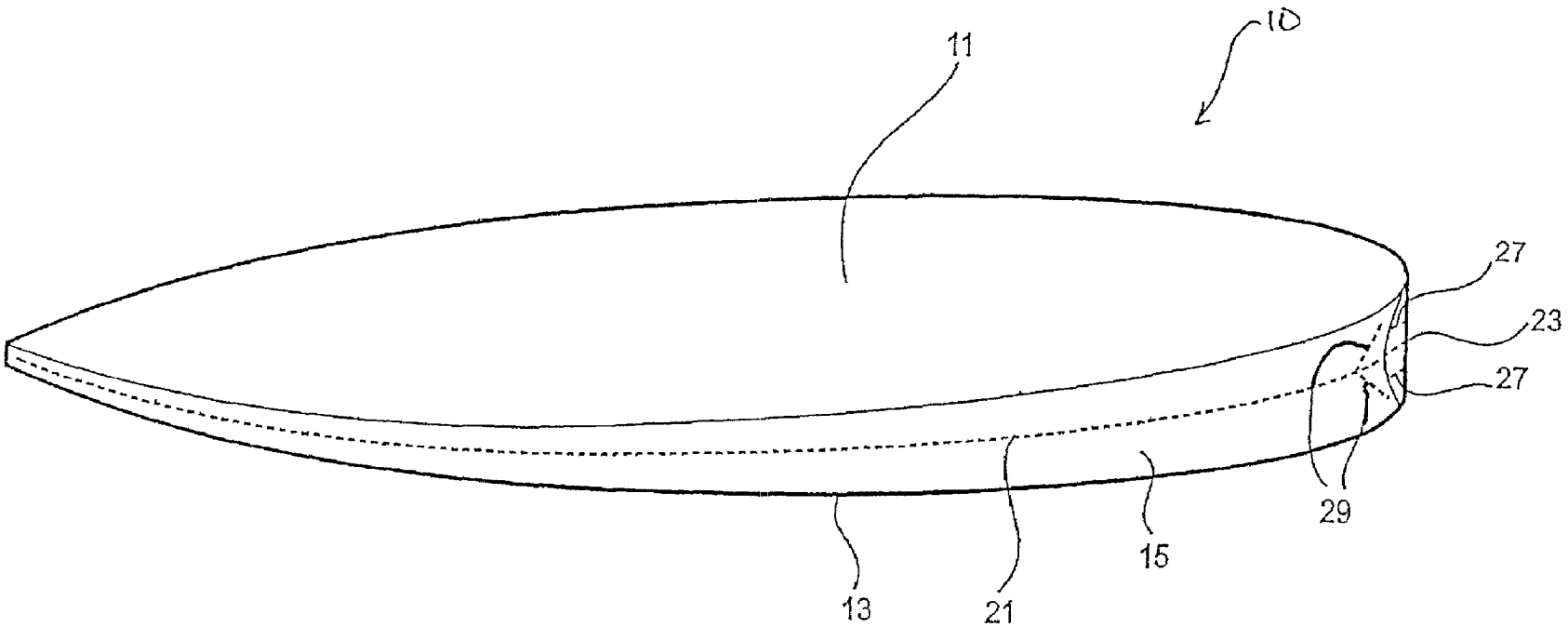
FIG. 1 comprises a schematic isometric view of a surfboard carry bag according to the embodiment.
Figure 3:
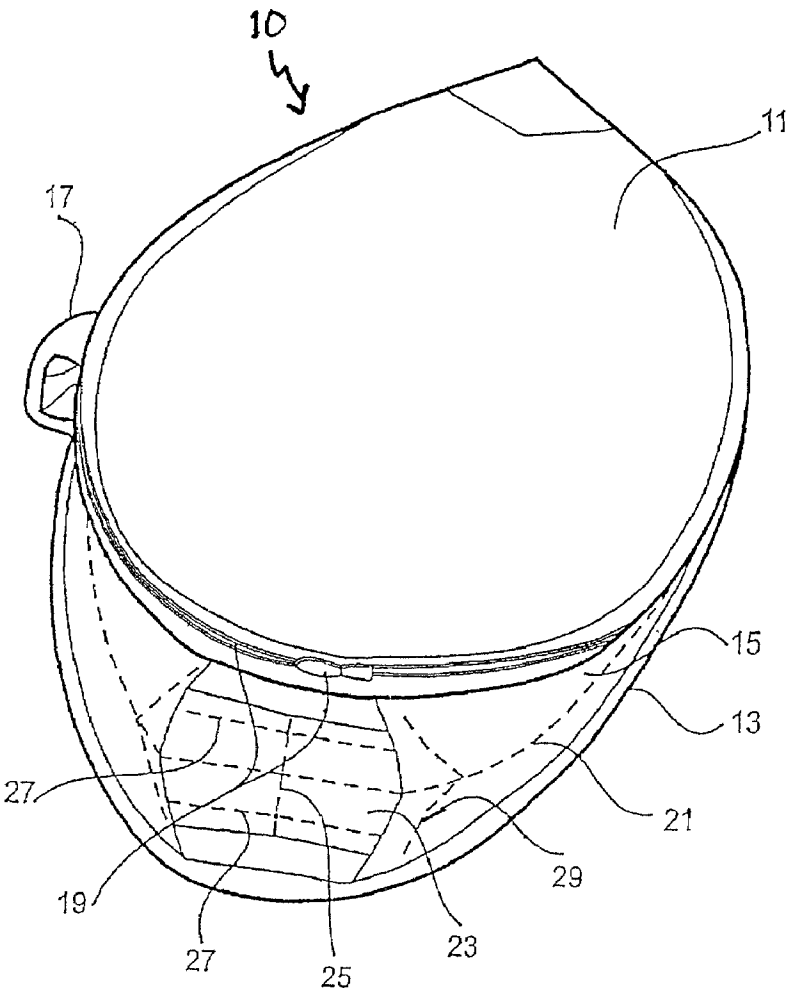
FIG. 3 is rear isometric view of the carry bag of FIG. 1 with the end portion being in an expanded condition.
Figure 2:
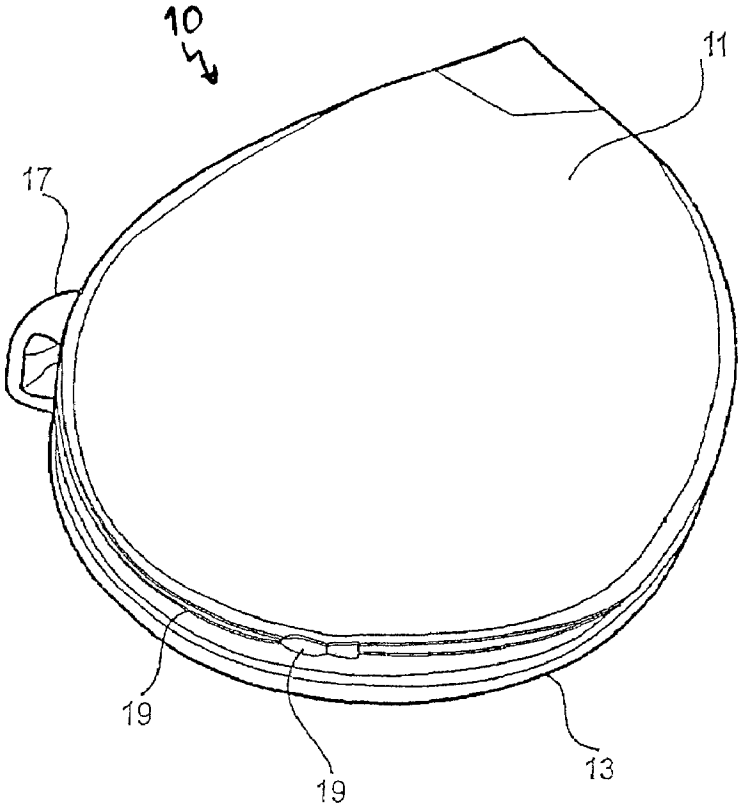
FIG. 2 is a rear view of a carry bag according to the embodiment with the side wall in a collapsed condition.
Figure 4B:
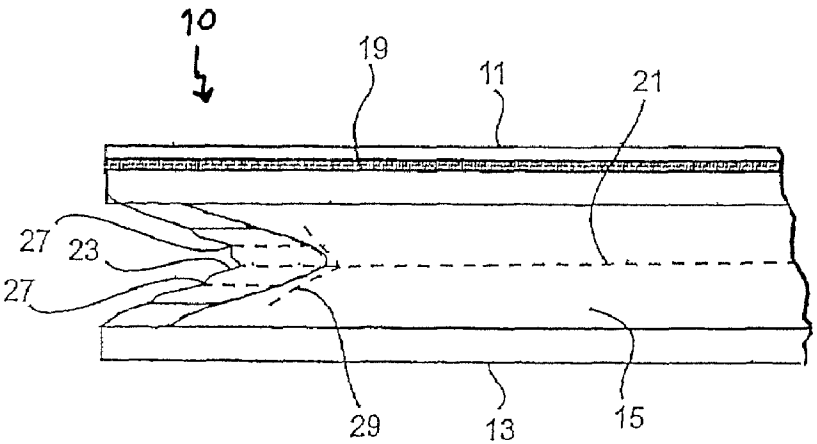
FIGS. 4A, B, C and D are schematic illustrations of the folding action of the end panel of the carry bag of the embodiment.
Figure 4D:
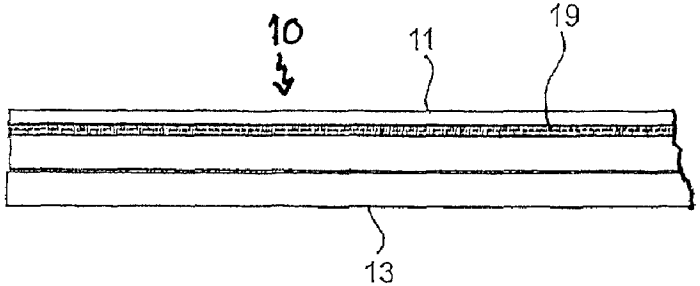
Figure 4A:
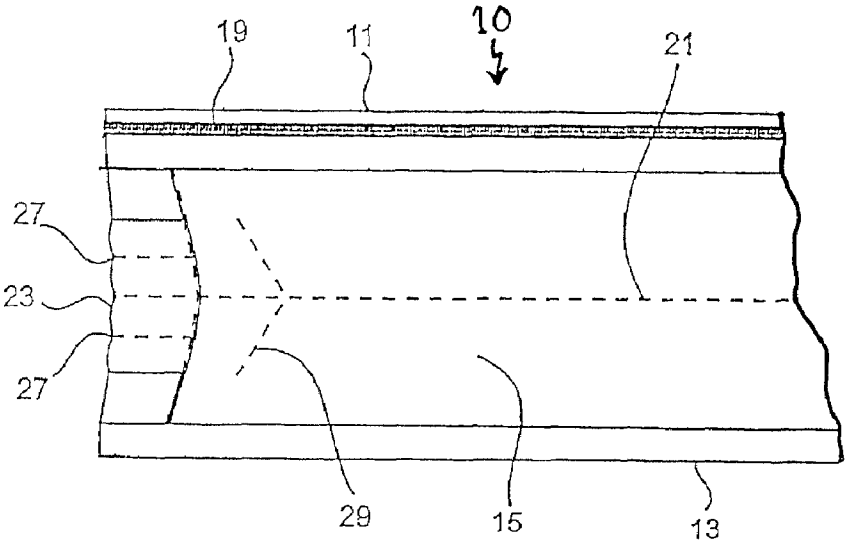
Figure 4C:
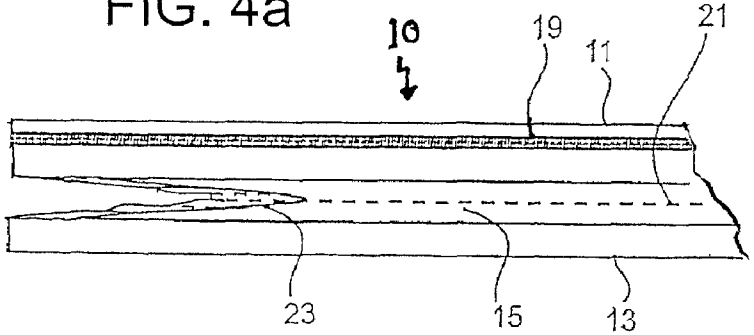

The embodiment as described as shown in the accompanying drawings relates to a carry bag for use with surfboards. There is a characteristic of the carry bags which are currently in use that they have the general configuration of a surfboard. This creates carry bags which are relatively large when empty or containing a surfboard. In addition because of the amorphous configuration of the existing carry bags they can be difficult to carry when containing a surfboard particularly for junior surfers.

The embodiment as shown comprises a carry bag 10 comprising a pair of major panels 11 and 13 which have the general configuration of the surfboard which is to be carried by the bag 10. The panels 11 and 13 are interconnected by a side wall 15 and a handle 17 is provided at one side of the carry bag 10 between the panels 11 and 13. The upper panel 11 is associated with a zipper or like closure 19 which extends around the perimeter of the panel to provide access into the interior of the carry bag 10.

The side wall 15 is of varying widths in order that when the carry bag 10 accommodates a surfboard having a tail fin at the rear end the bag 10 can accommodate the tail fin. The side wall 15 is formed of a multi-layered material which comprises outer layers of a suitable fabric or sheet-like material and an inner padding layer.

The side wall 15 is provided with a fold line 21 which extends for the full extent of the side wall and is located substantially intermediate of the main panels 11 and 13. The fold line at 21 is defined by a line of stitching which extends between the outer most layers of the side wall 15 and serves to hold these layers in close intimate contact with the padding layer.

The rear end of the bag 10 which is to accommodate the rear end of the surfboard accommodating the fin is provided with an end panel 23 which is formed as an integral part of the side wall 15 and is generally planar. The end panel 23 further accommodates a central fold line 25 which is perpendicular to the primary fold line 21. The end panel 23 is further provided with a set of second fold lines 27 which are disposed to each side of the primary fold line 21 and parallel thereto. The central fold line 25 and second fold lines 27 are also formed by stitching interconnecting the outer layers of the material forming the end panel 23. In addition, in the region of the side wall 15 adjacent each end of the rear end panel 23, the side wall 15 is formed with a pair of divergent fold lines 29 which extend from the primary fold line 21 towards the rear panel 23 in a divergent manner.

Figure 5:
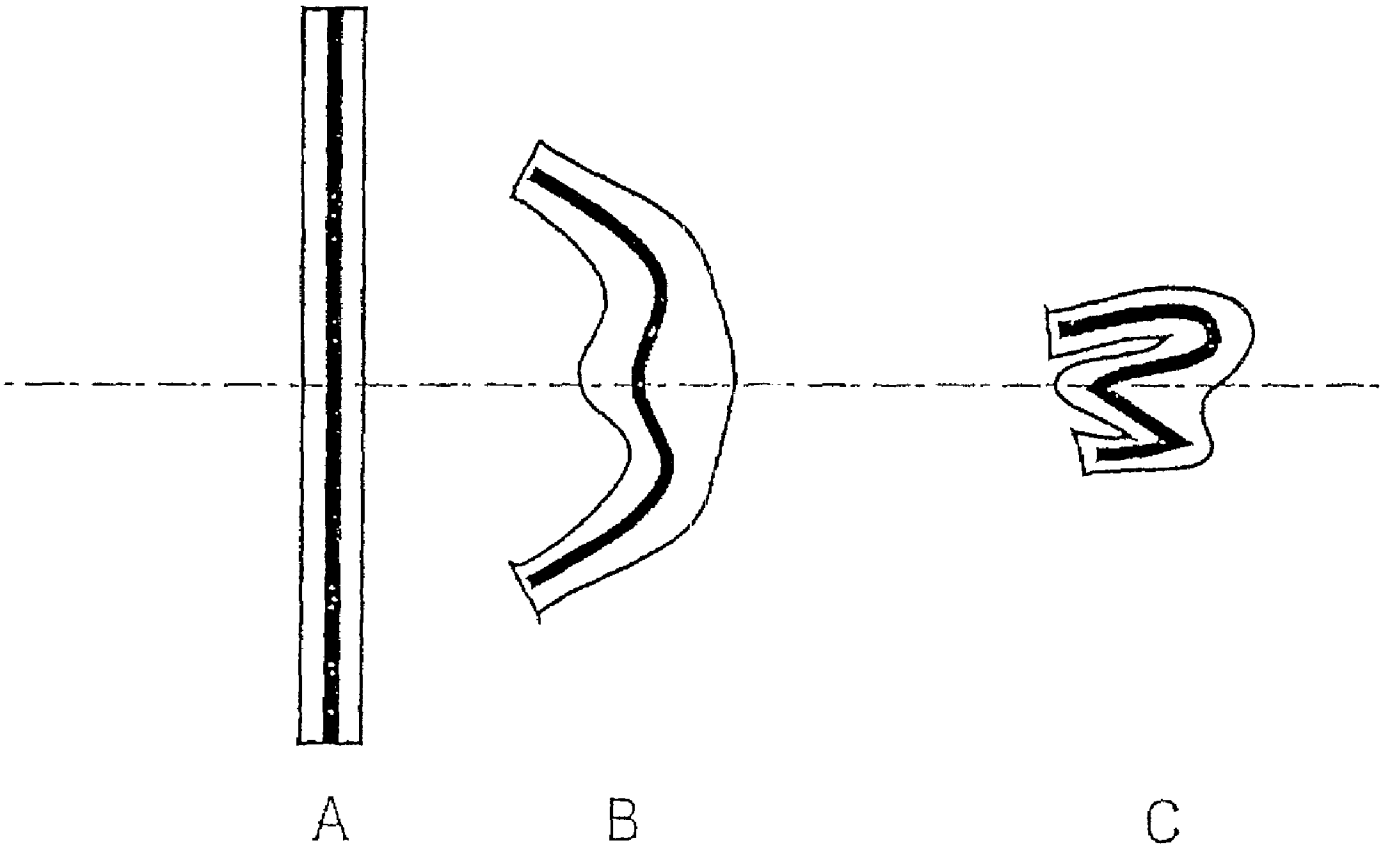
FIGS. 5A, B and C are illustrations of the folding of a layered sheet material in circumstances where a fold line according to the invention is not applied.

As illustrated at FIG. 4 the function of the fold lines 21, 25 and 27 as defined by the stitching interconnecting the outer layers of the material forming the side wall 15 serves to provide a line about which the side wall 15 will fold whereby the side wall 15 folds as a single integral element. FIG. 5 illustrates situation which is created where the layers of the material forming the side wall are not interconnected by the fold lines according to the present embodiment. As illustrated at FIG. 5C, once the side wall is caused to fold each layer will collapse independently of the others. In the case of the of the present embodiment the formation of the fold lines 21, 25 and 27 enables a panel such as the rear panel 23 and the remainder of the side panel 15 to fold about the fold lines in a controlled manner and inwardly with respect to the interior of the bag 10. In addition the divergent fold lines 29 enable a "dart" like formation to be formed by the ends of the end panel 23 as the end panel 23 is closed as illustrated at FIGS. 4A to D.

In addition the edges of the side wall 15 adjacent the major panels 11 and 13 are provided with a set of fasteners (not shown) which enable the edges of major panels 13 and 13 to be held in close abutting relationship with the side wall 15 folded inwardly of the edges. The fasteners are formed of a hook and loop like fastener of the form which is marketed under the trade mark VELCRO™.

It should be appreciated that the scope of the present invention need not be limited to the particular scope of the embodiment described above and in particular need not be limited to the application according to the embodiment of being used with a surfboard. For example, the interconnection between the layers along the fold line can alternatively comprise welding of the layers, such as by ultrasonic welding or other suitable type of joining the layers. Also, the end panel 23 can be integral with or incorporated with the side wall 15. Further, the major panels 11 and 13 can be made to be substantially rigid to substantially maintain their shape and provide protection for the surfboard.

Throughout the specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A carry bag to accommodate a surfboard, the bag comprising a pair of major panels which have the general configuration of the surfboard to be accommodated by the bag, the major panels being interconnected around perimeters thereof by a side wall formed of a flexible sheet material, a fold line being formed substantially a full extent of the side wall substantially intermediate to the major panels for folding the side wall inwardly, the flexible sheet material comprising outer layers of a fabric or sheet-like material and an inner padding layer and the fold line being defined by stitching extending between the outer layers of the side wall and holding these layers in close contact with the inner padding layer, the side wall including an end panel formed of the flexible sheet material, the end panel having an intermediate fold line aligned with the fold line of the side wall and a central fold line substantially perpendicular to the intermediate fold line.

2. A carry bag intended to accommodate a surfboard, the bag comprising a pair of major panels which have the general configuration of the surfboard to be accommodated by the bag, the major panels being interconnected around perimeters thereof by a side wall formed of a flexible sheet material, an intermediate fold line being formed substantially a full extent of the side wall substantially intermediate to the major panels for folding the side wall inwardly, the side wall including an end panel formed of the flexible sheet material, the end panel having an intermediate fold line aligned with the intermediate fold line of the side wall, wherein the end panel has a central fold line substantially perpendicular to the intermediate fold line of the end panel.

3. A carry bag intended to accommodate a surfboard, the bag comprising a pair of major panels which have the general configuration of the surfboard to be accommodated by the bag, the major panels being interconnected around perimeters thereof by a side wall formed of a flexible sheet material, an intermediate fold line being formed for substantially a full extent of the side wall substantially intermediate to the major panels for folding the side wall inwardly, the side wall being tapered from a rear end to a front end of the carry bag such that when the carry bag accommodates the surfboard having a tail fin at the rear end, the bag can accommodate the tail fin, the side wall including an end panel formed of the flexible sheet material, the end panel having an intermediate fold line aligned with the intermediate fold line of the side wall, the end panel further comprising a central fold line substantially perpendicular to the intermediate fold line of the end panel, wherein in regions of the side wall adjacent to the end panel, the side wall is formed with a pair of divergent fold lines which extend from the intermediate fold line of the side wall towards the end panel in a divergent manner.

4. The carry bag of claim 3, wherein the flexible sheet material of the side wall comprises outer layers of a fabric or sheet-like material and an inner padding layer and wherein the intermediate fold line of the side wall is defined by stitching extending between the outer layers of the side wall and holding these layers in close contact with the inner padding layer.

5. The carry bag of claim 3, wherein edges of the side wall adjacent the major panels are provided with a set of fasteners which enable edges of the major panels to be held together in close abutting relationship when the side wall is folded inwardly of the edges.

* * * * *